US006951169B2

(12) United States Patent
Ohno

(10) Patent No.: US 6,951,169 B2
(45) Date of Patent: Oct. 4, 2005

(54) HORIZONTAL GRINDING TYPE RICE MILLING MACHINE

(75) Inventor: Shigeo Ohno, Okayama (JP)

(73) Assignees: Seirei Kogyo Kabushikigaisha (JP); Yanmar Nouki Kabushikigaisha (JP)

( * ) Notice: Subject to any disclaimer, the term of this patent is extended or adjusted under 35 U.S.C. 154(b) by 0 days.

(21) Appl. No.: 10/480,197

(22) PCT Filed: Jun. 11, 2001

(86) PCT No.: PCT/JP01/04921

§ 371 (c)(1),
(2), (4) Date: Dec. 10, 2003

(87) PCT Pub. No.: WO02/100546

PCT Pub. Date: Dec. 19, 2002

(65) Prior Publication Data

US 2004/0177772 A1 Sep. 16, 2004

(51) Int. Cl.[7] ..... B02B 3/00; B02B 7/02

(52) U.S. Cl. ..... 99/519; 99/521; 99/528; 99/602; 99/605; 99/606; 99/613; 99/617

(58) Field of Search ..... 99/348, 483, 485–489, 99/516, 518–531, 600–606, 609–617, 618–622, 636; 241/7, 9, 11, 10, 14, 74, 76, 81, 159, 162; 426/481–483

(56) References Cited

U.S. PATENT DOCUMENTS

| | | | | | |
|---|---|---|---|---|---|
| 3,485,280 | A | * | 12/1969 | Satake | 99/614 |
| 4,133,257 | A | * | 1/1979 | Satake | 99/518 |
| 4,324,175 | A | * | 4/1982 | Satake | 99/519 |
| 4,425,841 | A | * | 1/1984 | Vick et al. | 99/605 |
| 4,426,922 | A | * | 1/1984 | Yamamoto | 99/519 |
| 4,515,075 | A | * | 5/1985 | Satake | 99/519 |
| 4,741,913 | A | * | 5/1988 | Satake | 426/483 |
| 4,913,045 | A | * | 4/1990 | Satake | 99/519 |
| 5,232,697 | A | * | 8/1993 | Bahrani | 424/738 |
| 5,394,792 | A | * | 3/1995 | Satake et al. | 99/519 |
| 5,476,036 | A | * | 12/1995 | Liebing | 99/519 |
| 5,542,616 | A | * | 8/1996 | Archer | 241/62 |
| 6,457,404 | B1 | * | 10/2002 | Munesada et al. | 99/519 |

FOREIGN PATENT DOCUMENTS

| | | |
|---|---|---|
| JP | 63-88051 A | 4/1988 |
| JP | 9-57122 A | 3/1997 |
| JP | 9-57123 A | 3/1997 |
| JP | 11-123338 A | 5/1999 |

* cited by examiner

*Primary Examiner*—Timothy F. Simone
(74) *Attorney, Agent, or Firm*—Sterne, Kessler, Goldstein & Fox, P.L.L.C.

(57) ABSTRACT

In a horizontal grinding-type rice polishing machine which is so configured that a grinding roller (1) installed circularly and fixedly on a horizontal rotation axis (10) is covered with a concentric cylindrical bran removing screen (S) that can be split into longitudinal two screen halves (2) to thereby form a rice polishing room, the total of even number of a stopper (3) and a flap (4) are fixedly provided on an inner peripheral surface of each of two-part split screen halves (2) of the bran removing screen (S) so that they align alternately in the axial direction, the stopper (3) and the flap (4) being formed by a circular arc member which curves along the circumference of a circular cross section perpendicular to the axial center of the cylinder. Between the flap (4) and the outer periphery of the grinding roller (1), a distance that allows passing of rice while restricting passing amount is secured, and a distance between the stopper (3) and the outer periphery of the grinding roller (1) prevents the rice from flowing. The screen halves (2) of the bran removing screen (S) have the same structure, and are so configured that when the respective ends in the axial direction are inverted, the stopper (3) and the flap (4) are inverted, and in the rice polishing machine, at least one screen half (2) can be arranged so that the respective ends in the axial direction are inverted. Also, position of a joint surface (J) between the screen halves (2) is variable in the circumferential direction about the rotation axis (10).

4 Claims, 15 Drawing Sheets

HORIZONTAL GRINDING TYPE RICE MILLING MACHINE

BACKGROUND OF THE INVENTION

1. Field of the Invention

The present invention relates to a horizontal grinding-type rice polishing (milling) machine in which a feeding roller, a grinding roller and a discharging roller are circularly and fixedly installed on a horizontal rotation axis from one end side to the other end side, and the grinding roller is covered with a bran removing screen of concentric cylindrical shape to form a lice polishing room, whereby unpolished rice supplied by the feeding roller is polished in the rice polishing room and discharged from the discharging roller as polished rice.

2. Background Art

A horizontal grinding-type rice polishing machine which is so configured that a feeding roller, (a plurality of) grinding rollers and a discharging roller are circularly and fixedly installed on a horizontal rotation axis from one end side to the other end side, and the grinding roller is covered with a bran removing screen of concentric cylindrical shape to form a rice polishing room, whereby unpolished rice supplied by the feeding roller is polished in the rice polishing room and discharged from the discharging roller as polished rice has been conventionally known in the art.

In the rice polishing machine of the above configuration, unpolished rice is deliver from an unpolished rice hopper and fed into the rice polishing room through a spiral groove formed on the outer periphery of the feeding roller. In the rice polishing room, rice being polished or rice after polished (hereinafter, "rice" in the rice polishing room refers to the rice in mixed state of unpolished rice, rice being polished and rice after polished) is pushed out to the discharging roller as a result of being pushed by the unpolished rice which is successively fed by the feeding roller, and finally pushed into a polished rice outlet from the discharging roller.

It is requested that polishing degree of polished rice is adjusted in accordance with the intended polishing degree, and in accordance with the type of the rice, and the polishing degree can be adjusted by changing the residence time, the loading amount and the passage in the rice polishing room.

As a means for appropriately setting the residence time and loading amount in the rice polishing room, a stopper for restricting passage by preventing flow of the rice or a flap for controlling the flow rate is conventionally provided along the inner peripheral surface of the bran removing screen. The stopper is fixedly provided on the inner peripheral surface of the bran removing screen so as to make the gap with respect to the grinding roller extremely small thereby preventing the rice from flowing and guiding the rice to the region where a stopper is not provided, and thus restricting the passage. The flap narrows the gap with respect to the grinding roller to some degree, thereby controlling the flow rate of the rice in the gap. That is, according to the conventional measure, the loading amount and the flow rate (residence time) of the rice in the rice polishing room are adjusted by making the flap variable or enabling manual changing of its angle by an operator.

However, such a variable-type flap applied along the circumferential direction of the bran removing screen cannot be so long. That is, such a flap cannot be effective along the substantially entire circumference of the bran removing screen, so that there is a limitation in equalizing distribution of rice in the rice polishing room. This made the structure of the bran removing screen complicated.

Also, though a structure in which a fixed-type flap is fixedly provided on the inner peripheral surface of the bran removing screen in the same manner as the stopper is also adopted in combination with the variable flap, since the bran removing screen itself is essentially fixedly provided and cannot be modulated in accordance with the type of the rice or the intended polishing degree, the position of the fixed-type flap is also fixed and there is a case that a desired polishing degree cannot be achieved.

As another means for adjusting the polishing degree, a structure of adjusting free opening of an outlet of polished rice is known. That is, at an outlet of polished rice, a shutter having a pushing force against the flow direction of polished rice is provided, and free opening of the shutter is adjusted. The narrower the free opening, the higher the polishing degree becomes because of increase of the residence time in the rice polishing room.

However, if the free opening is controlled as described above, the polishing efficiency is deteriorated on the other hand. That is, as a result of decreasing the discharge amount of the polished rice per unit time, longer time is required for obtaining the intended amount of polished rice.

Yet another problem associated with the conventional horizontal grinding-type rice polishing machine is that since the spiral groove of the feeding roller is formed as one groove from the initial end surface to the terminal end surface of the roller, the pressure of the unpolished rice to be discharged into the rice polishing room from the outlet end of the groove concentrates at one point under rotation, and rotation of the pressure concentrated point may cause vibration of axial center of the rotation axis. Furthermore, in association with that the degree of pressure application on the rice polishing room in one rotation varies depending on arrangement of the stopper and flap provided nearest to the inlet in the rice polishing room and opposing to the terminal end surface of the feeding roller, vibration occurs in the grinding roller, which results in unequal rice polishing or adversely affects on the durability of parts.

Furthermore, in assembling the grinding roller and discharging roller on the rotation axis, the assembly is proceeded in the manner that first the feeding roller is assembled on the rotation axis while cantilevering the inlet end side of the rotation axis, and thereafter the center hole of each grinding roller is passed on the rotation axis to be slid to a predetermined position in sequence. However, as the grinding rollers are assembled to the rotation axis, the part of the outlet side end is downwardly inclined because of the weight of the grinding rollers. This causes the assembled grinding rollers to slide toward the outlet side end and come off, and also causes a trouble in assembling additional grinding roller to a predetermined position.

BRIEF SUMMARY OF THE INVENTION

The present invention relates to a horizontal grinding-type rice polishing machine which is so configured that a feeding roller, a grinding roller and a discharging roller are circularly and fixedly installed on a horizontal rotation axis from one end side to the other end side, and the grinding roller is covered with a concentric cylindrical bran removing screen to form a rice polishing room, whereby unpolished rice supplied by the feeding roller is polished in the rice polishing room and discharged from the discharging roller, and the first object of the invention is to configure adjusting members for adjusting loading amount and residence time of rice in the rice polishing room that is attached inside the bran removing screen with simple and effective structures.

In order to achieve this object, according to the present invention, a stopper or a flap is fixedly provided on an inner peripheral surface of each of the two-part split screen halves of the bran removing screen, the stopper or the flap being formed by a circular arc member which curves along the circumference of a circular cross section perpendicular to the axial center of the cylinder, so that between the flap and the outer periphery of the grinding roller, a distance that allows passing of rice while restricting passing amount is secured, and a distance between the stopper and the outer periphery of the grinding roller prevents the rice from flowing.

Therefore, it becomes possible to achieve sufficient loading of unpolished rice and residence time in the rice polishing space by means of a fixed-type stopper and flap with simple structure without providing a movable flap inside the bran removing screen as is the conventional case.

Also, position of a joint surface between the screen halves of the bran removing screen is variable in the circumferential direction about the rotation axis, whereby the position of the stopper or flap attached to each screen half is made changeable in the circumferential direction about the rotation axis. For example, by making it possible to arrange the joint surface in horizontal position and in vertical position, it is possible to prepare two types of bran removing screens, that is, the bran removing screen configured by jointing the screen halves one on another, and the bran removing screen configured by jointing the screen halves side to side. As a result of this, the flow passage of rice in the rice polishing room is changed with regard to the circumferential direction of the bran removing screen, and moreover, relative positions of the stopper and the flap with respect to the unpolished rice outlet in the upstream side feeding roller and the discharging roller and polished rice outlet on the downstream side of the rice polishing room are changed in the circumferential direction about the rotation axis. Therefore, delivery of rice in the rice polishing room and introduction of unpolished rice to the rice polishing room and discharge of polished rice from the rice polishing room can be optimized, resulting that the rice polishing performance is improved.

In the case where it is desired to change the polishing degree in accordance with the type or property of the unpolished rice, by preparing several types of screen halves having different attaching positions and shapes (thickness and the like) of the stopper and flap, and forming the bran removing screen while selecting and combining arbitrary two types among these types, it is possible to comply with various types and properties of unpolished rice.

Furthermore, the screen halves of the bran removing screen have the same structure, and are so configured that when the respective ends in the axial direction are inverted, the stopper and the flap are inverted, and in the rice polishing machine, at least one screen half can be arranged so that the respective ends in the axial direction are inverted.

As described above, it is possible to configure two types of bran removing screens each having different setting of loading amount and residence time in accordance with the type or the like of unpolished rice by preparing two screen halves having the same structure, so that a horizontal grinding-type rice polishing machine having many conforming variations can be provided with low cost.

In each of the screen halves having the same structure, the total of even number of the stopper and the flap are attached so that they align alternately in the axial direction.

For example, assumption is made for the case that the bran removing screen is formed by jointing the screen halves one on the other, the upper screen half is made invertible as described above, and as for the lower screen half, the member nearest to the inlet side end is a stopper and the member nearest to the outlet side end is a flap.

When the member nearest to the inlet side end is a flap and the member nearest to the outlet side end is a stopper, in the upper screen half, all of combinations of stopper or flap arranged opposing to each other in the vertical direction while interposing each grinding roller therebetween are combination of stopper and flap. Incidentally, the vertical position of the flap and the stopper is transposed sequentially from the inlet side end. In this bran removing screen, most of rice blocked by each stopper flows to the outlet side via each flap.

When the upper screen half is inverted, and the member nearest to the inlet side end is a stopper an d the member nearest to the outlet side end is a flap, combinations of stopper or flap opposing to each other while interposing each grinding roller in the bran removing screen are such that combination of upper stopper and lower stopper and combination of upper flap and lower flap are alternately repeated in sequence from the inlet side end. Since the part where the stoppers are arranged on the upper and lower sides is configured, the flow passage of rice is extremely narrowed. The bran removing screen may be configured as described above when it is required to set the loading amount of rice and residence time in the rice polishing room higher.

The second object of the invention is to provide a structure capable of smoothly discharging polished rice in accordance with closing degree of outlet when a measure of changing loading amount and residence time of rice in the rice polishing room by changing free opening (closing degree of outlet) is adopted.

For achieving this object, a primary outlet having a shutter of which free opening is adjustable and a secondary outlet not having the shutter are provided, and by adjusting the free opening of the shutter, the polished rice is discharged from the primary outlet under low polishing degree condition, from the secondary outlet under high polishing degree condition and from the primary outlet and the secondary outlet under intermediate polishing degree condition.

Therefore, by adjusting residence time and loading amount of rice in the rice polishing room by adjustment of free opening of the shutter, it is possible to smoothly discharge rice of high polishing degree from the secondary outlet even when the closing degree is increased, while having the structure of changing the polishing degree. On the other hand, when it is requested to obtain rice of low polishing degree, the opening degree of the shutter is increased, thereby discharging such rice immediately from the primary outlet.

In such a configuration, by providing the secondary outlet at higher position than the primary outlet, it is possible to discharge rice of high polishing degree from the secondary outlet in response to an increase of the level of rice that is filled in the rice polishing room and not discharged from the primary outlet when the opening degree of the shutter is decreased.

Furthermore, when the secondary outlet for high polishing degree is provided in duplicate, it is possible to further increase the polishing degree by selectively closing one of the outlets and elongating the residence time in the rice polishing room, and it is possible to increase polishing efficiency by using both of the outlets.

Furthermore, by providing a pair of secondary outlets disposed left and right when viewed in the direction of the rotation axis, it is possible to guide the rice discharged from the secondary outlets to the polished rice discharging trough while allowing the rice to drop smoothly and equally leftward and rightward of the rotation axis.

Furthermore, the third object of the present invention is to eliminate deviation of supply of unpolished rice from the feeding roller to the rice polishing room, thereby preventing occurrence of vibration of the rotation axis. In a horizontal grinding-type rice polishing machine having a structure that unpolished rice is drawn into a spiral groove formed on the circumference of the feeding roller from an unpolished rice hopper; unpolished rice is supplied inside the rice polishing room from an outlet end of the spiral groove by means of rotation of the feeding roller.

In order to achieve this object, according to the present invention, a pair of spiral grooves of the feeding roller is formed with a phase shift of 180° in the circumferential direction of the feeding roller. As a result of this, it is possible to feed the unpolished rice in well-dispersed condition from the feeding roller to the rice polishing room, so that the rotation axis is prevented from vibrating and vibration does not occur during rotation of the grinding roller, with the result that uniform rice polishing is secured and durability of parts is improved.

Furthermore, the fourth object of the present invention is to provide a structure for supporting the rotation axis, or roller shaft, in a horizontal position so that when the grinding rollers and the discharging roller are assembled on the rotation axis, the cantilevered rotation axis will not be inclined due to weight of the fitted grinding rollers and the like.

In order to achieve this object, according to the present invention, a case for accommodating the feeding roller has a lifter latching block, and the rotation axis is supported in horizontal position by inserting the lifter latching block between the feeding roller that has been attached on the rotation axis and the bearing support which cantilevers the rotation axis when installing the grinding roller and the discharging roller on the rotation axis.

As a result of this, the rotation axis will not be inclined until the rotation axis is inserted into each of the grinding rollers and discharging roller and each of the grinding rollers and discharging roller are slid to predetermined positions on the rotation axis to be fitted therewith, so that the grinding rollers having fitted with the axis will not fall off, and hence assembling operation of the grinding rollers and discharging roller on the rotation axis can be conducted readily and smoothly.

Furthermore, the bearing support is formed with a recess portion nearest the position where the lifter latching block is to be positioned for horizontally supporting the rotation axis, and the lifter latching block not being used is fitted in the recess portion. That is, during when it lifting and supporting of the rotation axis is not required, the block is placed on the bearing support at the position where the block will not prevent rotation of the rotation axis and the feeding roller. In the case of detaching the grinding roller or discharging roller from the rotation axis because of maintenance and the like, the detaching operation can be smoothly conducted because the block is placed near the setting position.

The above and other objects, features and advantages of the present invention will become more apparent from the following detailed description based on the attached drawings.

BRIEF DESCRIPTION OF THE DRAWINGS

FIG. 11(*b*) is a section view taken in the direction of the arrows along the line b—b in FIG. 10; FIG. 11(*c*) is a section view taken in the direction of the arrows along the line c—c in FIG. 10; and FIG. 11(*d*) is a section view taken in the direction of the arrows along the line d—d in FIG. 10.

FIG. 13(*b*) is a section view taken in the direction of the arrows along the line b—b in FIG. 12; FIG. 13(*c*) is a section view taken in the direction of the arrows along the line c—c in FIG. 12; and FIG. 13(*d*) is a section view taken in the direction of the arrows along the line d—d in FIG. 12.

DETAILED DESCRIPTION OF THE INVENTION

Mode for Carrying Out the Invention

Figure 1:
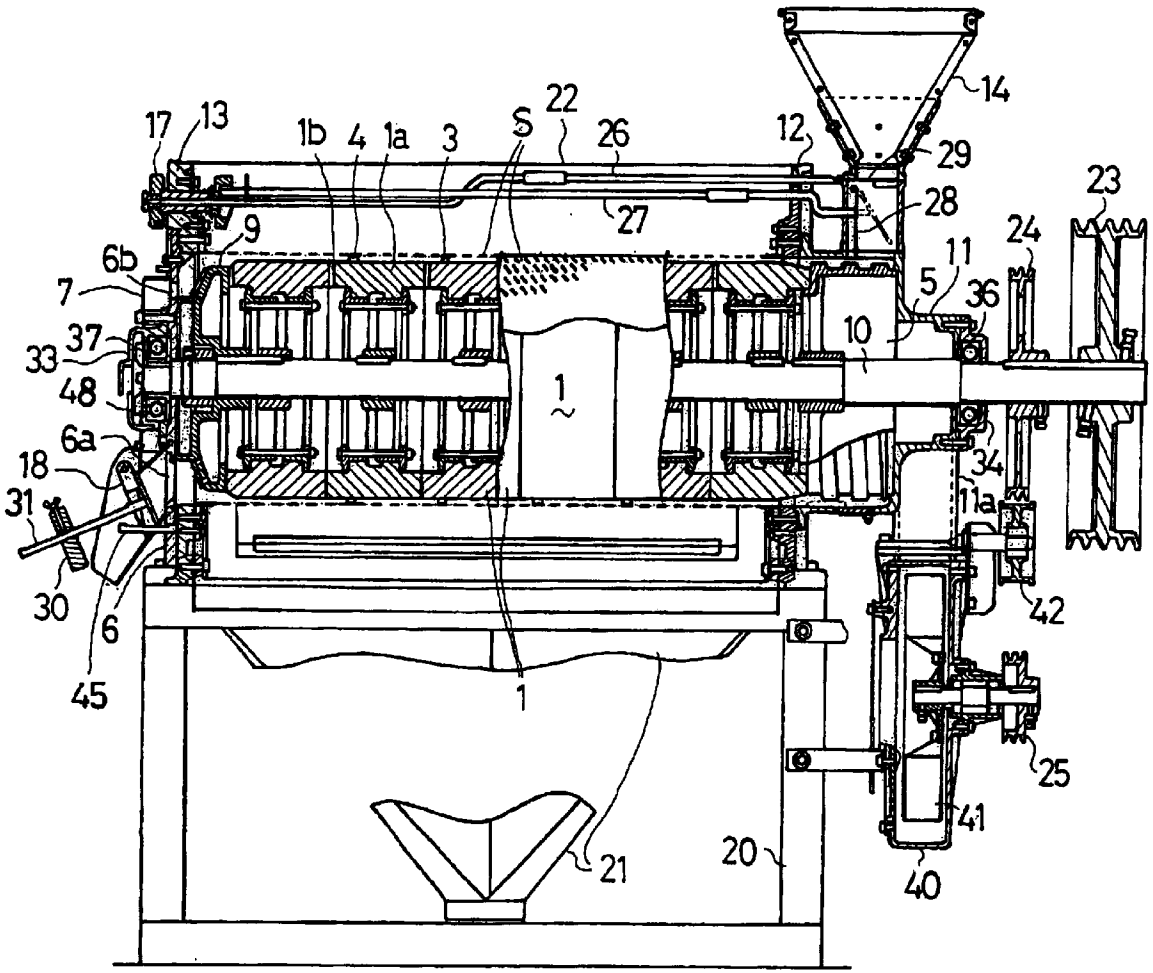
FIG. 1 is a general side elevation view of a horizontal grinding-type rice polishing machine according to the present invention.
Figure 2:
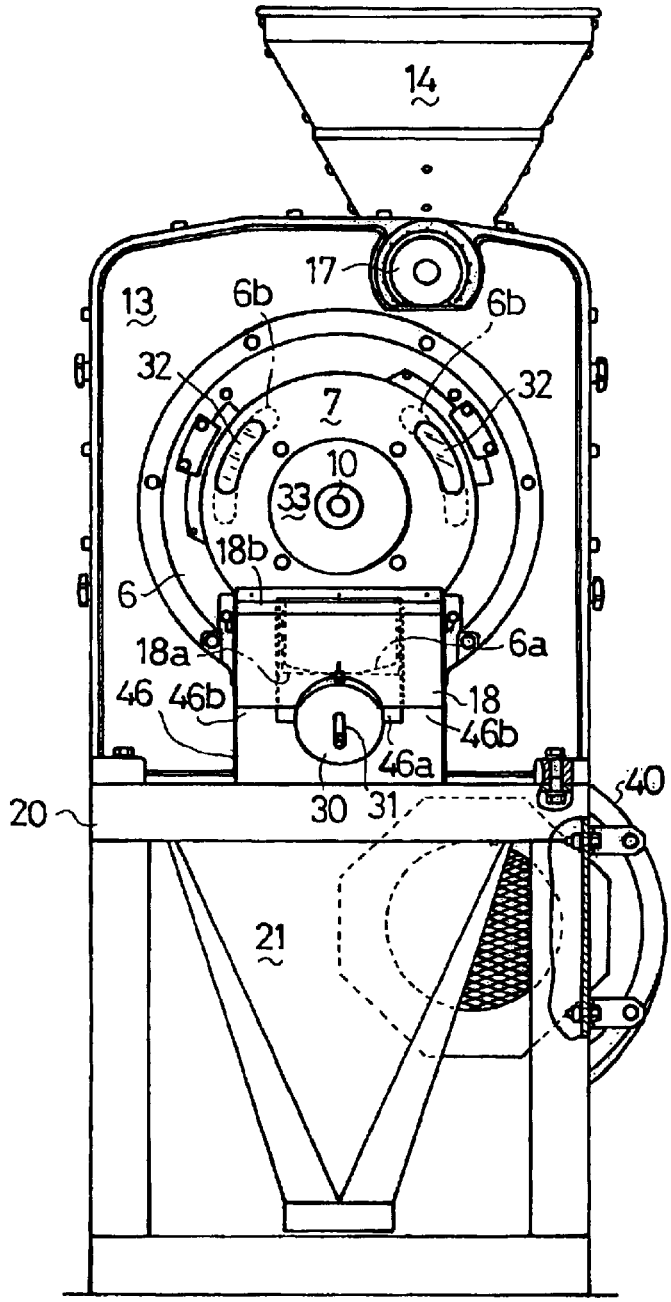
FIG. 2 is a front view of the same showing the polished rice outlet side.

In the following, general configuration of the horizontal grinding-type rice polishing machine according to the present invention will be explained with reference to FIGS. 1 to 4.

On a lower supporting frame 20, an inlet side supporting panel (front panel) 12 and an outlet side supporting panel (rear panel) 13 are fixedly provided in standing manner while leaving a fore-and-aft span therebetween, and a cylindrical rice polishing unit cover 22 is interposed between the inlet side supporting panel 12 and the outlet side supporting panel 13. Hereinafter, unless otherwise specified, the present machine will be explained provided that the side of the outlet side supporting panel 13 (left side in FIG. 1) is the front side and the side of the inlet side supporting panel 12 (right side in FIG. 1) is rear side.

A feeding roller case 11 is fixedly provided on the back of the inlet side supporting panel 12, and an unpolished rice hopper 14 for supplying a rice polishing unit with unpolished rice is fixedly provided on the feeding roller case 11. Inside the unpolished rice hopper 14, an opening/closing shutter 29 is horizontally fitted so as to be able to advance and retract in the fore-and-aft direction, and on the lower side of the downstream side of the opening/closing shutter 29, a fine-adjusting shutter 28 is provided so as to be able to swivel in the fore-and-aft direction.

The opening/closing shutter 29 and the fine-adjusting shutter 28 are connected to an unpolished rice supply amount adjusting dial 17 mounted on the outlet side supporting panel 13 via an adjusting connecting rod 26 and an adjusting connecting rod 27, respectively. Also, the adjusting connecting rods 26 and 27 pass through the rice polishing unit cover 22. An operator operates the unpolished rice supply amount adjusting dial 17 while checking the amount or the speed of the polished rice discharged from polished rice outlets 6*a* and 6*b* formed in a polished rice outlet member 6 which is fixedly provided on the outlet side supporting panel 13 and will be described later, thereby causing the adjusting connecting rod 26 or 27 to advance or retract in the fore-and-aft direction to open/close the opening/closing shutter 29 or to adjust the opening of the fine-adjusting shutter 28, thus achieving adjustment of the flow amount of unpolished from the unpolished rice hopper 14.

A grinding roller shaft 10, or rotation axis, is horizontally journaled between the inlet side supporting panel 12 and the outlet side supporting panel 13 while being covered with the rice polishing unit cover 22. In the working example of FIG. 1, a feeding roller 5, six grinding rollers 1, a discharging roller 9 and an end portion clamping screw 35 are fitted on the grinding roller shaft 10.

The feeding roller 5 is arranged in the feeding roller case 11, and in the rice polishing unit cover 22, the six grinding rollers 1, the discharging roller 9 and the end portion clamping screw 35 are arranged in this order toward the outlet side supporting panel 13. Furthermore, the six grinding rollers 1 and the discharging roller 9 are covered with a bran removing screen S cylindrically interposed between the inlet side supporting panel 12 and the outlet side supporting panel 13 within the rice polishing unit cover 22. In this way, the rice polishing unit is formed between the inlet side supporting panel 12 and the outlet side supporting panel 13.

Arrangement of the grinding roller shaft 10, and procedure of assembling the feeding roller 5, the grinding rollers 1, the discharging roller 9 and the end portion clamping screw 35 on the grinding roller shaft 10 will be explained with the use of FIGS. 1, 5, 6 and the like.

First, the inlet side supporting panel 12 and the outlet side supporting panel 13 are fixedly provided on the lower supporting frame 20 in standing manner, and the feeding roller case 11 is fixedly provided on the inlet side supporting panel 12 as described above, and then a bearing cover 34 for wrapping a bearing 36 is fixedly provided on the outside end (rear end) of the feeding roller case 11.

From this state, the grinding roller shaft 10 is inserted into axial holes of the bearing 36 and the bearing cover 34 attached to the feeding roller case 11 from front side via a polished rice discharging opening of the outlet side supporting panel 13 (see FIGS. 1, 16 and 17), and a step of the grinding roller shaft 10 is brought into contact with the bearing 36.

The grinding roller shaft 10 thus positioned in the axial direction protrudes behind the bearing 36, that is, protrudes on the opposite side to the polished rice discharging side, and an input pulley 23 for receiving engine power and a bran removing fan driving pulley 24 for driving a bran removing fan 41 as will be described later are circularly installed and fixed to this protruded portion as weights. Under the condition that the rear end part of the grinding roller shaft 10 is weighed, the constituents of the rice polishing unit as described above are sequentially slid from the front end part of the polished rice outlet side along the grinding roller shaft 10 and latched after being positioned.

Among the constituents of the rice polishing unit to be assembled on the grinding roller shaft 10, first, the grinding roller shaft 10 penetrates the center hole of the feeding roller 5, the feeding roller 5 is slid backward along the grinding roller shaft 10, and in the state of being in contact with the step provided in the grinding roller shaft 10, the feeding roller 5 is latched to the grinding roller shaft 10 via a key so as to disable relative rotation.

In the condition that the feeding roller 5 is fitted to the grinding roller shaft 10 in the feeding roller case II, the remainder of the constituents of the rice polishing unit, that is, the six grinding rollers 1, the one discharging roller 9 are fitted from the polished rice outlet side. In this operation, if the grinding roller shaft 10 is inclined frontward and downward because of the weight of the grinding rollers 1 sequentially assembled, it is no longer possible to easily slide the grinding rollers 1 and the discharging roller 9 to the respective predetermined positions on grinding roller shaft 10, and even if such rollers are latched by means of keys, they will come off again. In view of this, as shown by the imaginary lines in FIGS. 1 and 5, a lifter latching block 8 is interposed between the lower end of the feeding roller 5 and the bottom surface of the roller case 11, thereby supporting the grinding roller shaft 10 together with the feeding roller 5 from below.

Figure 6:
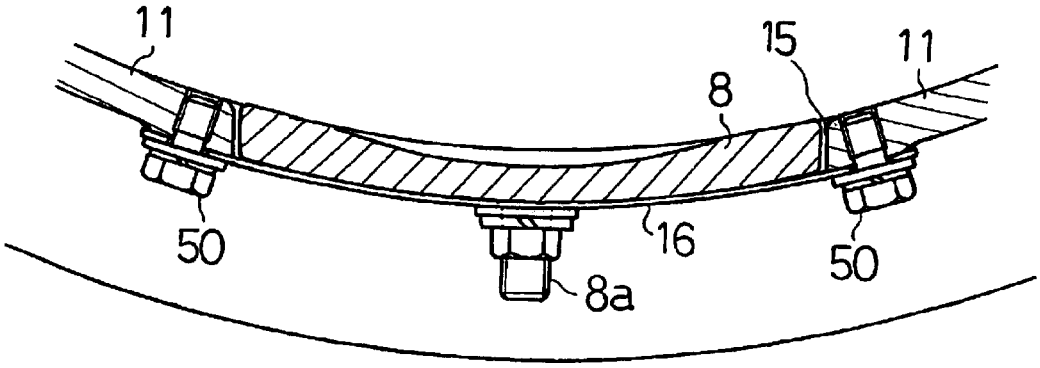
FIG. 6 is a section view taken in the direction of the arrows along the line VI—VI in FIG. 5.

As shown in FIG. 6, the lifter latching block 8 is arranged in a vertically penetrating hole 15 provide in the bottom portion of the feeding roller case 11 in the normal condition, and fixed by screw to a closing lid 16 disposed beneath the same by means of a hold-functioning bolt with nut 8*a*. Furthermore, the closing lid 16 is clamped to the feeding roller case 11 by means of a bolt 50. In this way in the case where it is not necessary to interpose the lifter latching block 8 under the feeding roller 5, such as during normal rice polishing operation, the lifter latching block 8 is arranged in the hole 15 while being attached inside the closing lid 16 to form a part of the feeding roller case 11.

Figure 5:
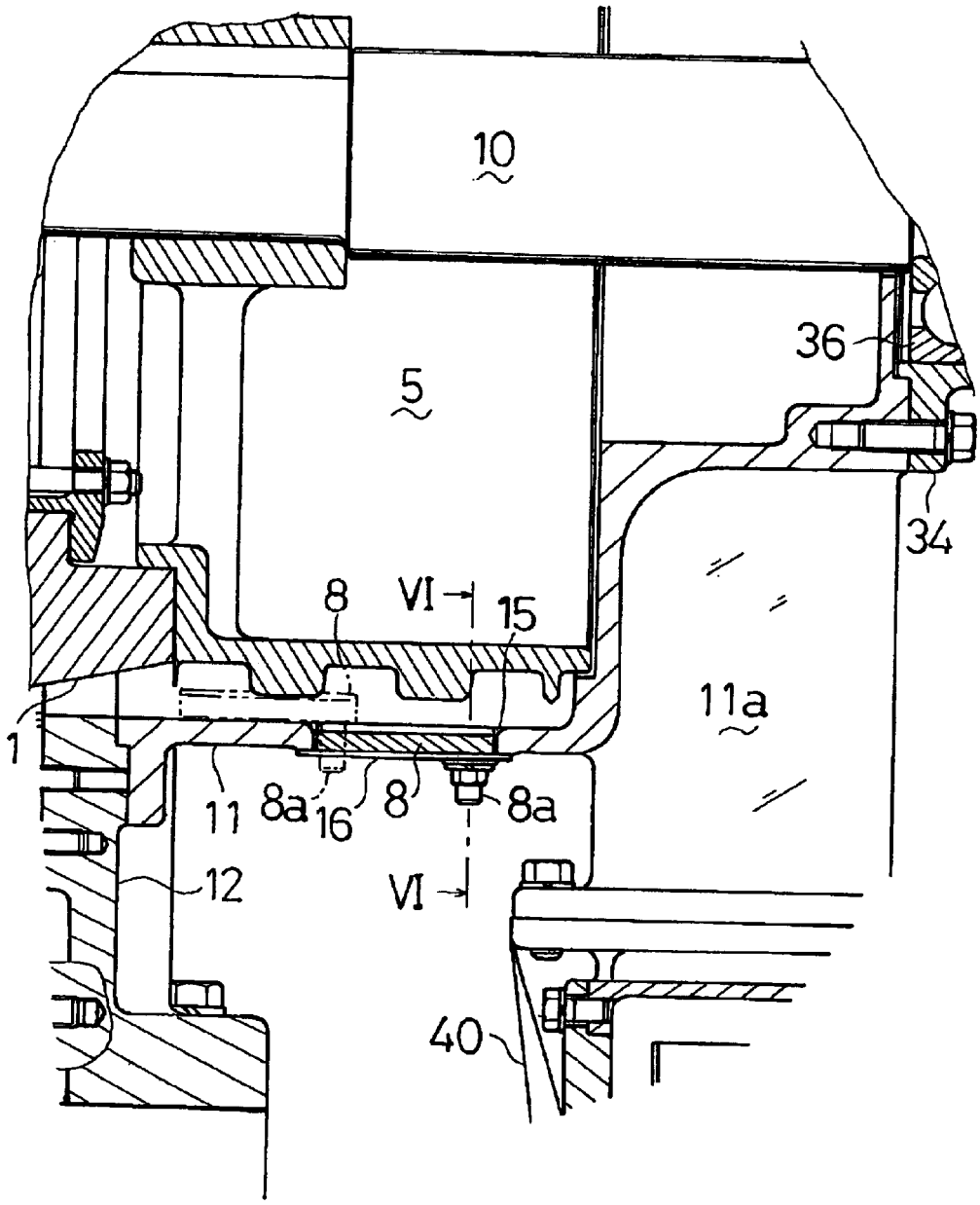
FIG. 5 is a partial side elevation view showing the part where a lifter latching block 8 is disposed in the lower part of a feeding roller case 11 of the horizontal grinding-type rice polishing machine.

And, when attaching/detaching the grinding rollers 1 to/from the grinding roller shaft 10, the lifter latching block 8 is separated from the closing lid 16 by removing the nut from the hold-functioning bolt 8*a*, and as shown by the imaginary line in FIG. 5, the lifter latching block 8 is inserted into an inlet bearing support 11 and moved, to be inserted between the bottom surface of the feeding roller 5 and the inner surface of the feeding roller case 11. At this time, the operator can easily move the lifter latching block 8 while holding the hold-functioning bolt 8*a*, and since the hold-functioning bolt 8*a* exists in the hole 15, the lifter latching block 8 does not exceedingly enter the interior.

As described above, by supporting the feeding roller 5 by interposing the lifter latching block 8 between the feeding roller S and the feeding roller case 11, it is possible to hold the grinding roller shaft 10 in substantially horizontal position, and it is possible to easily and reliably slide each grinding roller 1 and the discharging roller 9 to the respective predetermined positions on the grinding roller shaft 10 and latched with keys until the last end portion clamping screw 35 is fitted on the grinding roller shaft 10.

Each grinding roller 1 having been slid to a predetermined position on the grinding roller shaft 10 is latched so as to disable rotation relative to the grinding roller shaft 10, and after fitting of all of the grinding rollers 1, the discharging roller 9 is fitted on the-grinding roller shaft 10. Then, in this state, the feeding roller 5, the grinding rollers 1, the discharging roller 9 are slid toward the polished rice outlet side and fixed by clamping so as not to come off the grinding roller shaft 10 by screwing the end clamping screw 35 on the grinding roller shaft 10. Furthermore, the polished rice outlet member 6 is attached and fixed to the outlet side supporting panel 13 while inserting the grinding roller shaft 10 in an axial hole 6*c* of the polished rice outlet member 6, and a bearing cover 33 is fixedly provided on the polished rice outlet member 6 while fitting the Font end portion of the grinding roller shaft 10 in an axial hole of the bearing cover 33 which wraps a bearing 37. In this way, assembly of constituents of the rice polishing unit to be assemble to the grinding roller shaft 10 completes.

Figure 4:
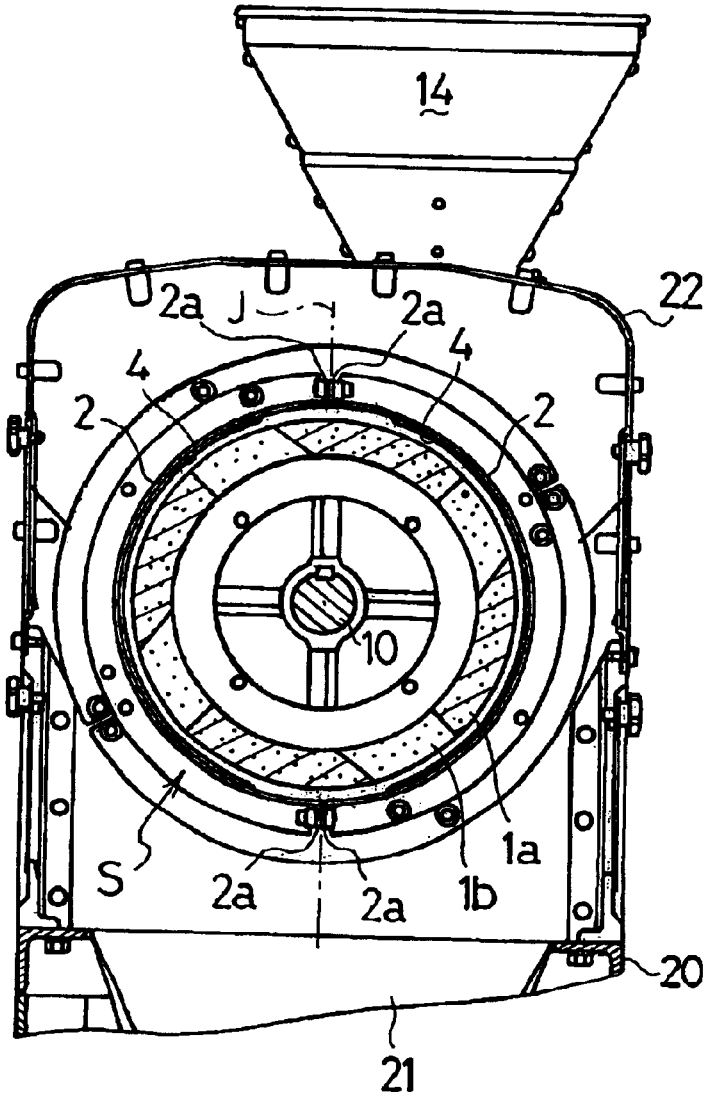
FIG. 4 is a sectional front view of the same showing a middle part of the fore-and-aft direction of a rice polishing unit, wherein a joint surface J of screen halves 2 constituting a bran removing screen S is the vertical surface.
Figure 7:
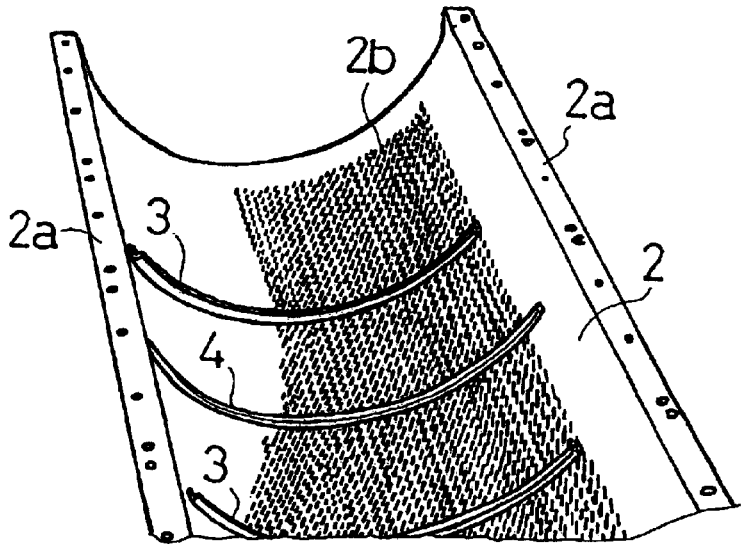
FIG. 7 is a front view of a bran removing screen S which is so configured that the joint surface J of the screen halves 2 is the horizontal surface, in which a stopper 3 and a flap 4 are attached to each of the upper and the lower screen halves 2U and 2L.
Figure 8:
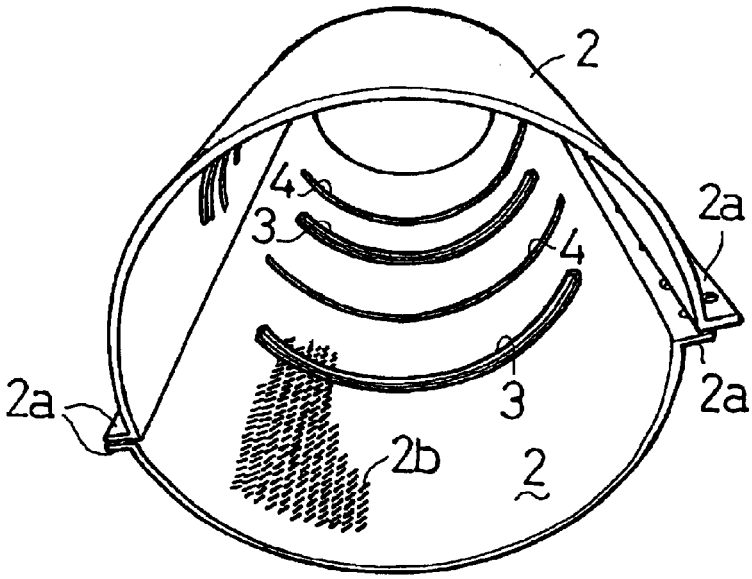
FIG. 8 is a partial perspective view of a screen half 2 in which a stopper 3 and a flap 4 are alternately attached on its inner peripheral surface.
Figure 9:
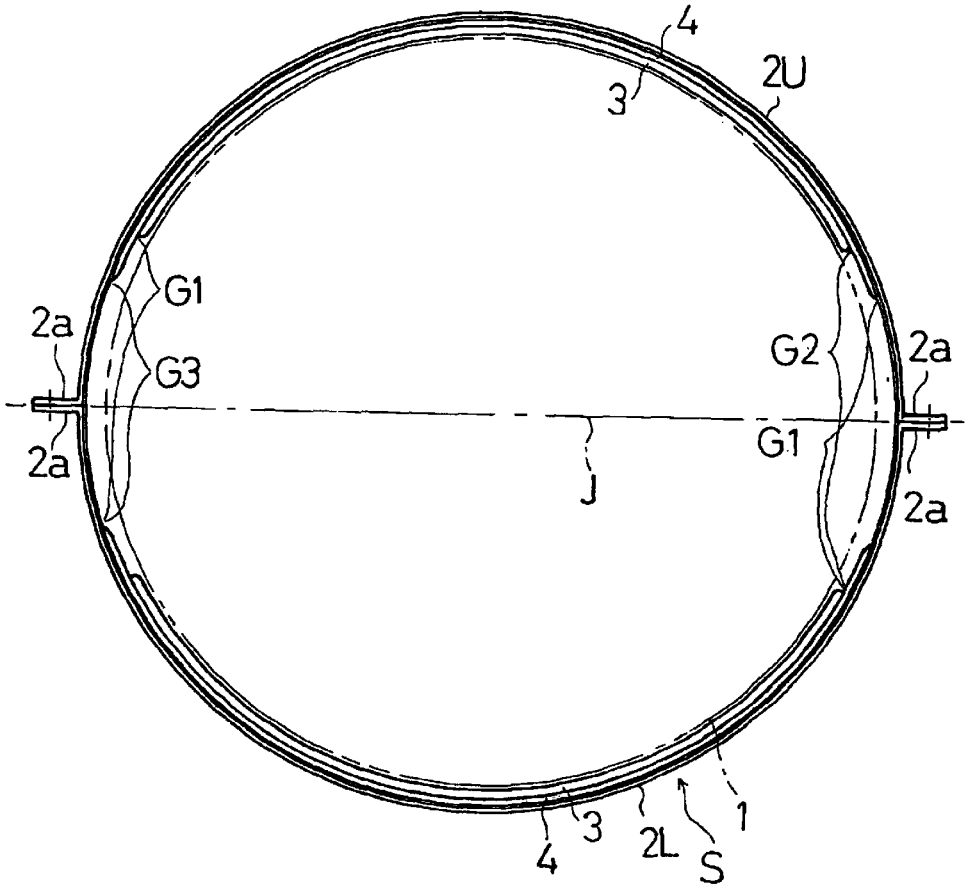
FIG. 9 is a perspective view showing the state that two screen halves 2 are overlapped with each other.

After that, two screen halves 2 of half-split cylindrical shape as shown in FIGS. 7 and 8 are arranged around the grinding roller 1, and joint flanges 2*a* which are formed at the outer peripheral ends of the screen halves 2 so as to parallel to the axial center are jointed and clamped with each other, thereby forming a single cylindrical bran removing screen S as shown in FIGS. 4, 9 and the like. Furthermore, as shown in FIG. 1, on an inlet side opening end and an outlet side opening end of the bran removing screen S, the inlet side supporting panel 12 and the outlet side supporting panel 13 are fixed respectively, whereby the bran removing screen S is interposed between the supporting panels 12 and 13 provided in the fore-and-aft direction. In this way, an approximately circular rice polishing unit is formed between the cylindrical bran removing screen S and the grinding rollers 1.

Figure 10:
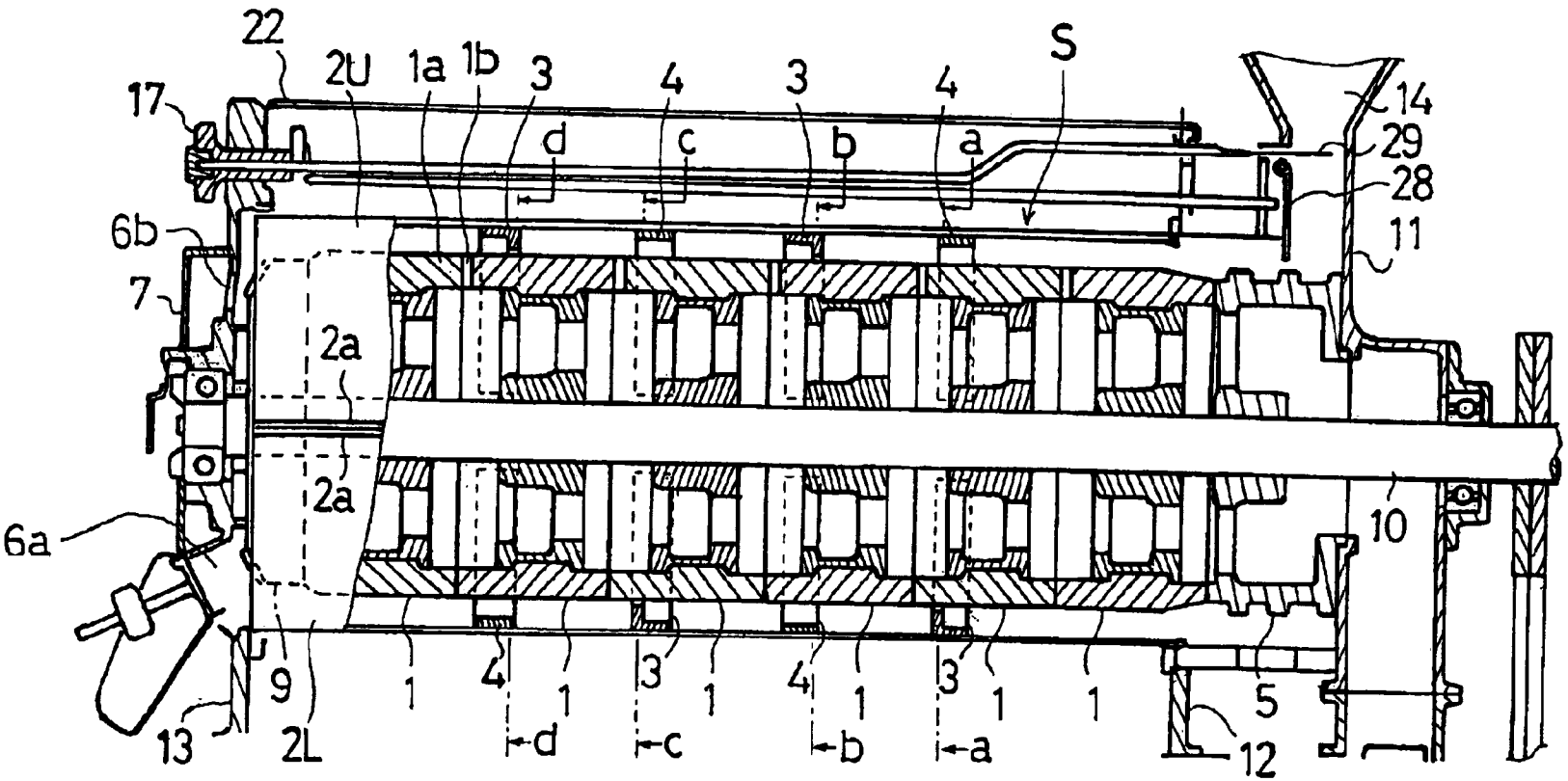
FIG. 10 is a schematic side elevation view of a horizontal grinding-type rice polishing machine using a bran removing screen S which is configured by jointing a screen upper half 2U and a screen lower half 2L via a horizontal joint surface J, the screen upper halves 2U and 2L being two screen halves 2 of the same structure having a stopper 3 and a flap 4 alternately attached on its inner peripheral surface.

In the present rice polishing machine, as shown in FIGS. 9, 10 and the like, the position where the joint flanges 2*a* of the respective screen halves 2 are jointed with each other may be such that the screen halves 2 are arranged one on the other while interposing a horizontal joint surface J therebetween, or may be such that, as shown in FIG. 4, the joint surface J is vertically arranged and the screen halves 2 are arranged on the left and right sides of the joint surface J. As described above, by rotationally moving the position of the screen halves 2 (position of the joint flanges 2*a*) about the grinding roller shaft 10, it is possible to change the positions of a stopper 3 and a flap 4 fixedly provided on the bran removing screen S as will be described later about the grinding roller shaft 10.

Furthermore, after interposing the above-described adjusting connecting rods 26 and 27 between inlet side supporting panel 12 and the outlet side supporting panel 13 above the bran removing screen S, the rice polishing unit cover 22 is interposed between the inlet side supporting panel 12 and the outlet side supporting panel 13 so as to cover the bran removing screen S and the adjusting connecting rods 26 and 27, whereby assembling of the rice polishing unit is almost completed.

As shown in FIG. 1, inside the lower supporting frame 20 is provided a funnel-shape bran collecting trough 21. During rice polishing operation, bran drops from the rice polishing room formed between the grinding rollers 1 and the bran removing screen S via a slit 2*b* of the bran removing screen S (see FIG. 7 and the like) to be collected in the bran collecting trough 21.

Also, in the rear part of the feeding roller case 11, a bran removing air duct 11*a* is formed, under which a bran removing fan case 40 wrapping the bran removing fan 41 is provided, and a blowing duct opening directed upwardly of the bran removing fan case 40 is jointed with the lower end inlet of the bran removing air duct la With such a configuration, the air generated by the bran removing fan 41 is introduced into the hollow feeding roller 5 within the feeding roller case 11 via the bran removing air duct 11*a*, and further introduced into the grinding roller 1 along the grinding roller shaft 10. Furthermore, a grinding stone 1*a* provided on the outer periphery of each grinding roller 1 is appropriately formed with blow passage 1*b* communicating inside and outside the grinding roller 1 as a notch as shown in FIGS. 1, 4 and the like, and the air from the bran removing fan 41 having been introduced into the grinding roller 1 is blown into the rice polishing room as bran removing air from inside the grinding roller 1, thereby discharged the bran into the bran collecting trough 21 via the slit 2*b* of the bran removing screen S from the rice polishing room.

Figure 3:
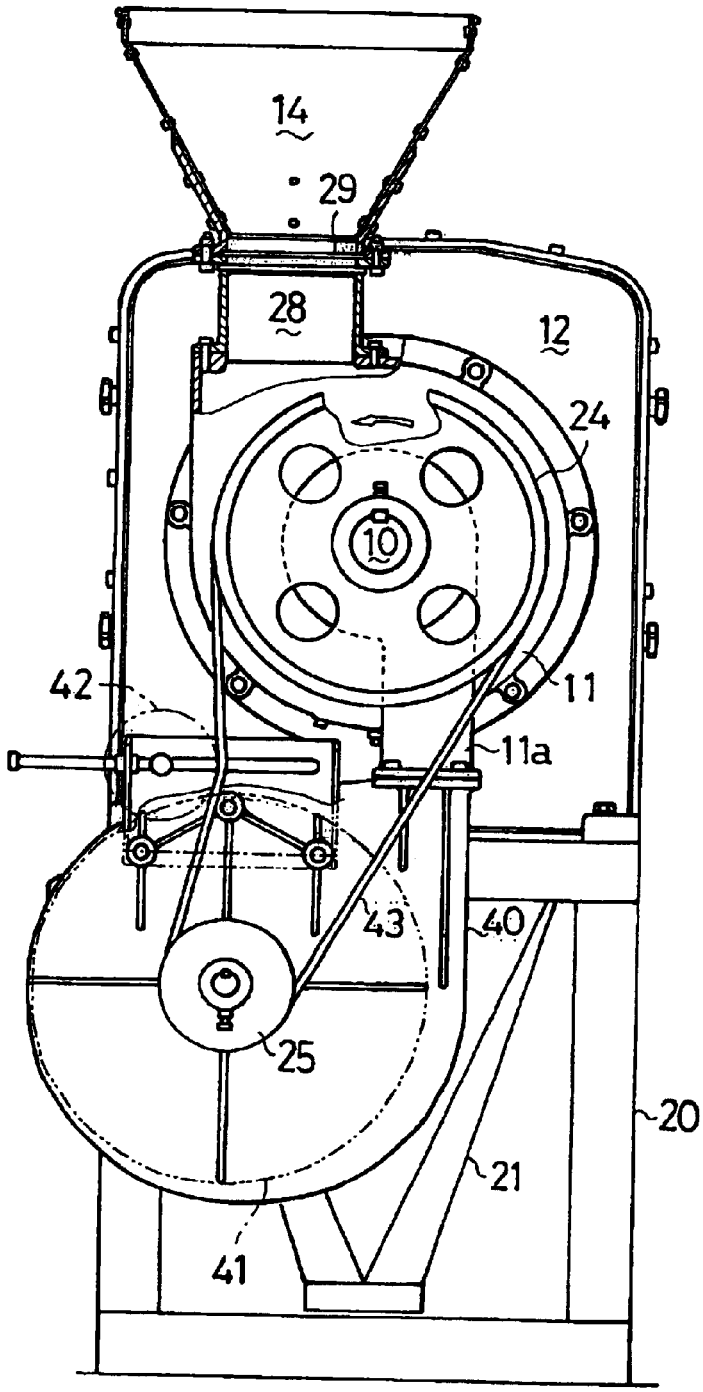
FIG. 3 is a rear view of the same showing the unpolished rice inlet side.

As shown in FIGS. 1 and 3, power is transmitted from the fan driving pulley 24 fixedly provided on the grinding roller shaft 10 to the fan input pulley 25 attached to the bran removing fan 41 via a belt 43, whereby the bran removing fan 41 is rotationally driven. For the purpose of adjusting the tension of the belt 43, a tension pulley 42 is attached on the rear surface of the upper part of the bran removing fan case 40 so as to allow position change in the left-and-right direction.

Next, arrangement and configuration of the stopper 3 and the flap 4 attached on the inner peripheral surface of the bran removing screen S shown in FIGS. 7 to 11 will be explained.

The bran removing screen S can be split longitudinally into the two screen halves 2 of half-split cylindrical shape according to the aforementioned configuration. On the inner peripheral surface of each screen half 2, as shown in FIGS. 7, 8 and the like, a plurality of stoppers 3 and flaps 4 are fixedly provided in parallel by spot welding in the circumferential direction thereof (in the direction of circular arc of the circular cross section perpendicular to the grinding roller shaft 10). Another possibility is to configure the screen half 2 to which only the stoppers 3 are attached or the screen half 2 to which only the flaps 4 are attached.

The flap 4 is a flat and slim plate member, and the stopper 3 is a slim plate member having an L-shaped cross section which is bent in a circular arc shape along the circumferential direction of the cross section of each screen half 2.

The distance between the inner peripheral surface of the bran removing screen S and the outer peripheral surface of the grinding roller 1 is about 8.5 mm. The thickness of the flap 4 is about 1.6 mm, and hence a gap of about 6.9 mm arises between the flap 4 and the inner peripheral surface of the bran removing screen S, which becomes resistance for rice flowing in the rice polishing room. That is, the flap 4 restricts flow amount of the rice, though it does not have a blocking power that completely blocks flow of the rice. In this way, it is possible to adjust the passing time and the residence time of the rice in the rice polishing room.

On the other hand, the thickness of the stopper 3 is about 7.5 mm, and hence a gap of only about 1 mm thick arises with respect to the inner peripheral surface of the bran removing screen S. Such a small gap prevents almost all of the rice from passing therethrough, so that the rice cannot move from the inlet side to the outlet side unless it keeps away from the stopper 3 in the rice polishing room. That is, the stopper 3 has a function of changing the passage of the rice.

Both the stopper 3 and the flap 4 provide a certain distance between the respective ends and the respective joint flanges 2*a* of the screen halves 2 in their longitudinal direction, thereby keeping a gap of about 8.5 mm thick for allowing passage of the rice as described above. Referring to FIG. 9, the distance between each end of the stopper 3 and the flange 2*a* is set to be a half of G2 (for example, about 85 mm), and the distance between each end of the flap 4 and the flange 2*a* is set to be a half of G3 (for example, about 60 mm).

As for the stopper 3 and the flap 4 within the bran removing screen S, various arrangements can be considered. First, in the present working example, as described above, the position of each of the screen halves 2 to be jointed with each other can be changed so that they surround the grinding roller shaft 10, and by changing the position as described above, it is possible to change the arrangement position of the stopper 3 and the flap 4 into the circumferential direction of the cross section perpendicular to the grinding roller shaft 10. For example, in FIG. 9, while the screen halves 2 are arranged one on the other and joined with each other via the horizontal joint surface J, it is also possible to arrange the screen halves 2 on the left and right sides and join them via the vertical joint surface J in the position rotated by 90° about the grinding roller shaft 10 as shown in FIG. 4, or to convert the screen halves 2 by rotation of 180°.

Since position of the stopper 3 and the flap 4 attached to each screen half 2 can be changed in the circumferential direction of the bran removing screen S, relative positions of the stopper 3 and the flap 4 with respect to the outlet ends of feeding spiral grooves 5*a* and 5*b* formed on the outer periphery of the feeding roller 5 on the upstream side of the rice polishing room as will be described later, the discharging roller 9, and accordingly the polished rice outlets 6*a* and 6*b* as will be described later are changed, so that it is possible to preferably adjust the conditions in introducing unpolished rice into the rice polishing room and in discharge polished rice from the polishing room.

Also various options can be expected as for arrangement of the stopper 3 and the flap 4 in each screen half 2, and various options can be expected as for combination of screen halves 2 having different configuration of the stopper 3 and flap 4.

As for each screen half 2, as shown in FIGS. 7 and 8, it is expected that two stoppers 3 and two flaps 4 are arranged alternately. Each of the stopper 3 and the flap 4 is arranged around the outer periphery of each, among the six grinding rollers 1 on the grinding roller shaft 10, of the middle four grinding rollers 1A, 1B, IC and ID other than two grinding rollers positioned on either side, as shown in FIGS. 10, 12 and the like.

Figure 11:
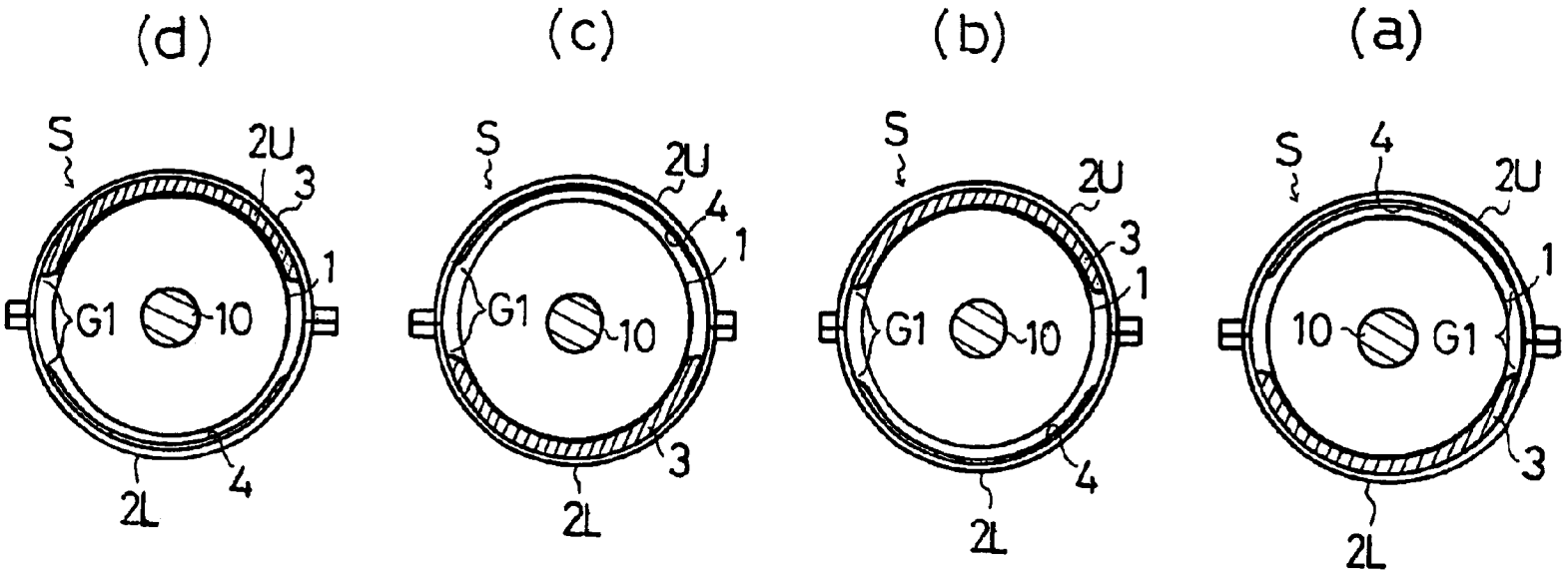
FIG. 11(*a*) is a section view taken in the direction of the arrows along the line a—a in FIG. 10.
Figure 12:
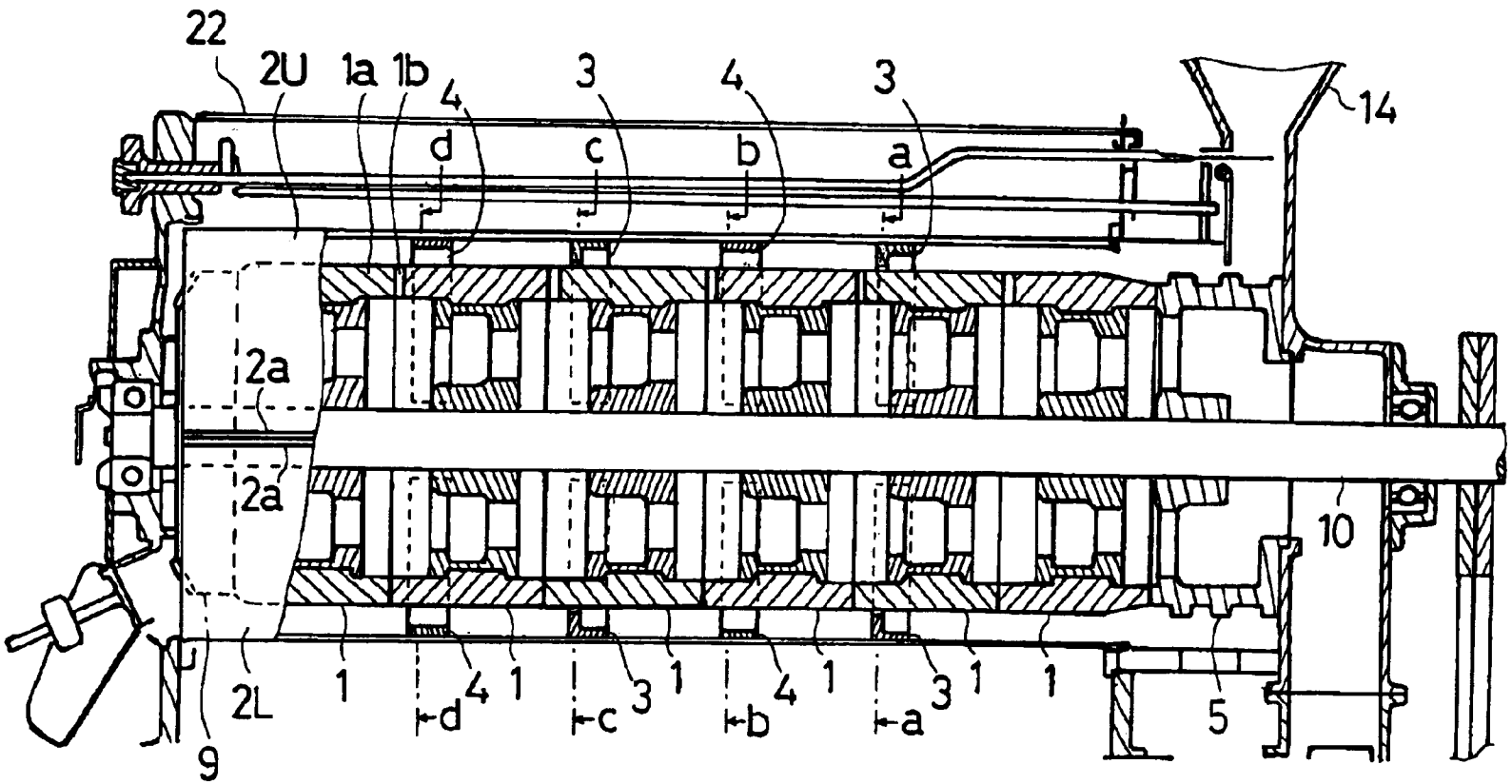
FIG. 12 is a schematic side elevation view of a horizontal grinding-type machine in the case where the bran removing screens is configured so that the screen upper half 2U shown in FIG. 10 is inverted in the fore-and-aft direction.
Figure 13:
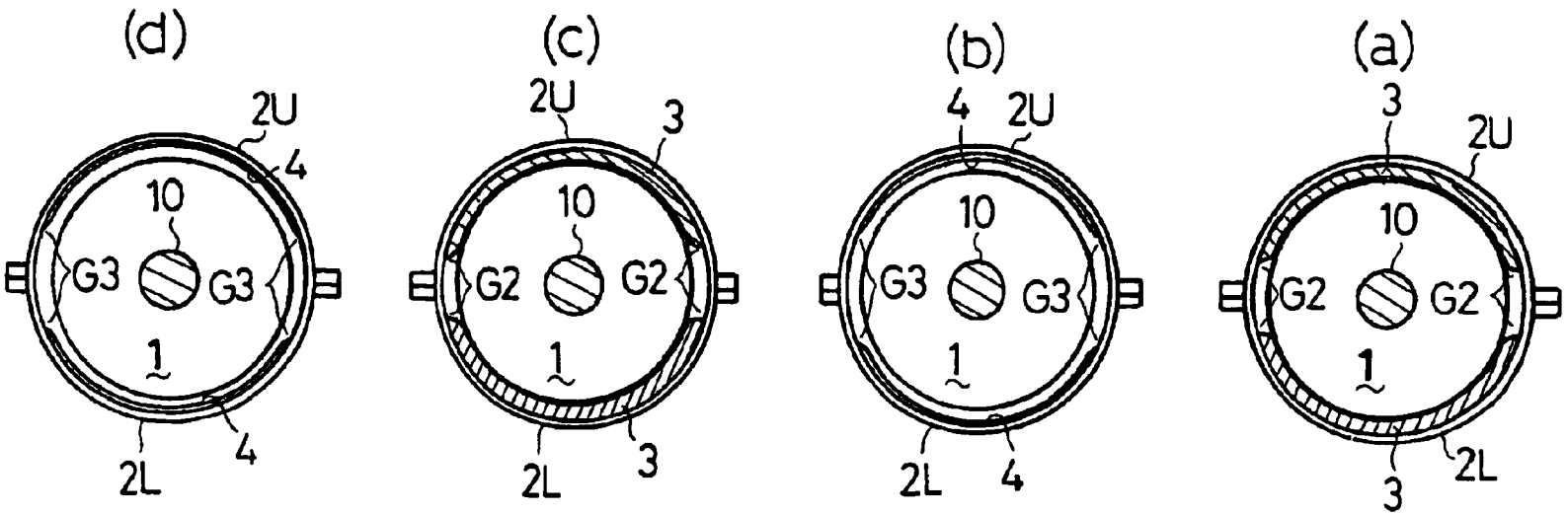
FIG. 13(*a*) is a section view taken in the direction of the arrows along the line a—a in FIG. 12.

FIGS. 9 to 13 show the bran removing screens S which is formed by arranging the screen halves 2 of the same structure one on the other to render them a screen upper half 2U and a screen lower half 2L, respectively, and joining them with each other, wherein the screen upper half 2U is inverted with regard to the fore-and-aft direction (the inlet end and the outlet end are inverted) between the bran removing screen S shown in FIGS. 10 and 11(*a*)–(*d*) and the bran removing screen S shown in FIG. 12 and FIGS. 13(*a*)–(*d*). As a consequence, the sequence in the grinding roller shaft 10 direction of the stopper 3 and the flap 4 arranged along the upper half outer periphery of each of the middle four grinding rollers 1 is also inverted between the screen upper halves 2U of the respective working examples.

In the case of the working example shown in FIG. 10 and FIGS. 11(*a*)–(*d*), among the grinding rollers 1, as for two grinding rollers, the upper half is surrounded by the flap 4 and the lower half is surrounded by the stopper 3 as shown in FIGS. 11(*a*) and (*c*), and as for the remaining two grinding rollers 1, the upper half is surrounded by the stopper 3 and the lower half is surrounded by the flap 4 as shown in FIGS. 11(*b*) and 11(*d*). In other words, for any of the middle four grinding rollers 1, either one of the upper half and the lower half is surrounded by the stopper 3 and the other the upper half and the lower half is surrounded by the flap 4.

To the contrary, in the cases of the working example shown in FIG. 12 and FIGS. 13(*a*)–(*d*), among the middle four grinding rollers 1, as for two grinding rollers, both of the upper half and the lower half are surrounded by the stopper 3 as shown in FIGS. 13(*a*) and (*c*), and as for the remaining two grinding rollers, both of the upper half and the lower half are surrounded by the flap 4 as shown in FIGS. 13(*b*) and (*d*).

If comparison is made for the fluidity of rice between these working examples, in the case where the bran removing screen S shown in FIGS. 12 and 13 are used, the rice existing on the upstream side of the pair of stoppers 3 vertically arranged in the rice polishing room can move downstream only via a very small gap of length G2 formed between the pair of stoppers 3 vertically formed on the left and right sides of the grinding rollers shown in FIGS. 13(*a*) and (*c*). For the remaining two grinding rollers 1B and 1D, the flaps 4 arranged in the vertical direction form thin gaps on the top and bottom and gaps having a regular thickness of G3 on the left and right sides of each grinding roller 1.

To the contrary, in the case where the bran removing screen S shown in FIG. 10 and FIG. 11, the stopper 3 is arranged on the outer periphery of each of the four middle grinding rollers 1 so that the rice is prevented from flowing from the inlet side to the outlet side in the rice polishing room, however, the rice flows from the inlet side to the outlet side via a thinned gap (hereinafter, referred to as "thin gap") between the flap 4 provided opposite to the stopper 3 and the grinding roller 1, and via gaps having a regular thickness of G1 on the left and right sides formed between the respective stopper 3 and flap 4 on the left and right sides of each grinding roller 1. Incidentally, the position of the thin gap is inverted in vertical direction for every one of the four middle grinding rollers 1, thereby preventing the communication of rice directed from the inlet side to the outlet side of the rice polishing room from deviating to either one of the upper side and lower side.

As described above, since the bran removing screen S shown in FIGS. 12 and 13 has higher effect of preventing flowing of rice by means of the stopper 3 than the bran removing screen S shown in FIGS. 10 and 11, and hence it can elongate the loading time and the residence time of the rice in the rice polishing room, the polishing degree is improved.

Which one is to be used may be determined in accordance with the practical request, however, even such a situation occurs that one embodiment of the bran removing screens S is desired, though the other embodiment of the bran removing screens S has been prepared, it is possible to immediately respond to such a situation by reassembling the screen S while inverting the screen upper half 2U with regard to the fore-and-aft direction (inverting the inlet end and the outlet end) from the both screen halves 2U and 2L.

Also, it is possible to invert the screen lower half 2L with regard to the fore-and-aft direction in place of the screen upper half 2U.

Alternatively, it is also possible that one of the two screen halves 2 has the stopper 3 and the flap 4 as shown in FIGS. 7 and 8, and the other of the two screen halves 2 has only the stopper 3, and these halves are assembled to form the bran removing screen S, or it is also possible that both of the screen halves 2 have only the stopper 3 for extremely improving the polishing degree. Also, it is possible to use the screen halves 2 having only the flap 4.

Figure 14:
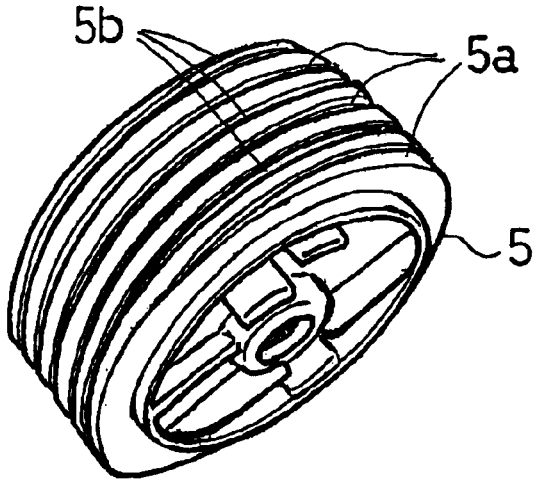
FIG. 14 is a perspective view of the feeding roller 5 having two unpolished rice feeding spiral grooves 5*a* and 5*b*.

Next, explanation on the unpolished rice feeding spiral groove 50 formed on the outer peripheral surface of the feeding roller 5 will be made with reference to FIG. 14.

The feeding roller 5 illustrated in FIG. 1 is formed with a single spiral groove (feeding spiral groove) 50 for taking unpolished rice dropping from the unpolished rice hopper 14 from its inlet end (right end) to its outlet end (left end) on its outer peripheral surface. To the contrary, the feeding roller 5 shown in FIG. 14 is formed with two feeding spiral grooves 5*a* and 5*b* which are parallel with each other on its outer peripheral surface. The feeding spiral grooves 5*a* and 5*b* are arranged with a phase shift of 1800 or arranged in such manner that the respective initial ends and the respective terminal ends of the grooves 5*a* and 5*b* are deviated by 180° from each other, respectively at the rear end peripheral edge and the front end peripheral edge of the feeding roller 5.

In this manner, since two feeding spiral grooves 5*a* and 5*b* alternately run in parallel and at regular intervals along the axial center of the feeding roller 5 on the outer peripheral surface of the feeding roller 5, the unpolished rice can be equally taken from the grooves 5*a* and 5*b*, and furthermore, unpolished rice is fed into the polishing room from the terminal ends of the grooves 5*a* and 5*b* of which rotation angles differ from each other by 180°, with the result that it is possible to reduce the vibration by keeping a balance during rotation of the grinding rollers 1.

Next, configuration of the polished rice outlet formed in the polished rice outlet member 6 will be explained.

Figure 15:
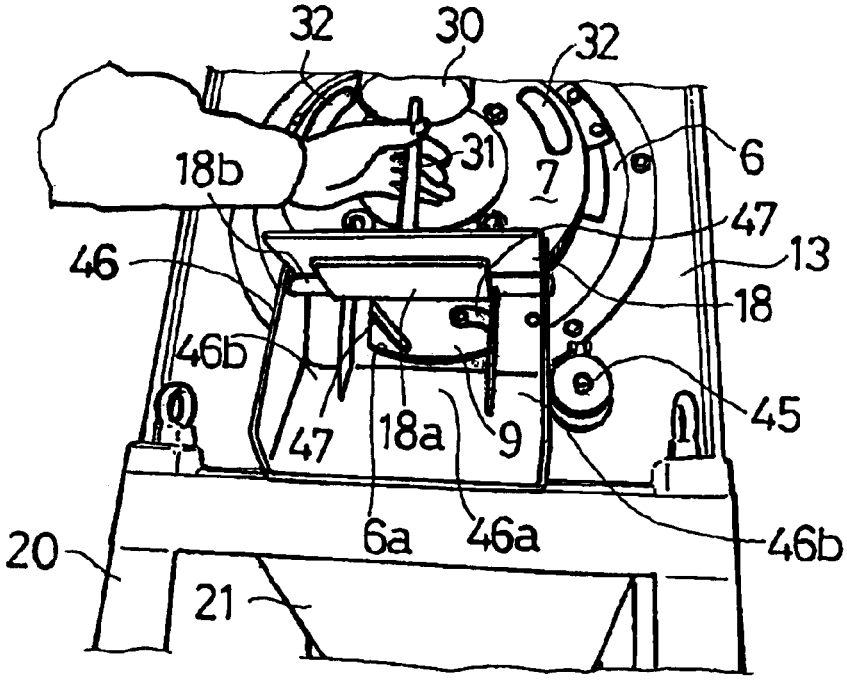
FIG. 15 is a partial perspective view showing an outlet side surface of the horizontal grinding-type rice polishing machine according to the present invention in the state that the lower polished rice outlet 6*a* is opened by swiveling the adjusting shutter 18 upward.
Figure 16:
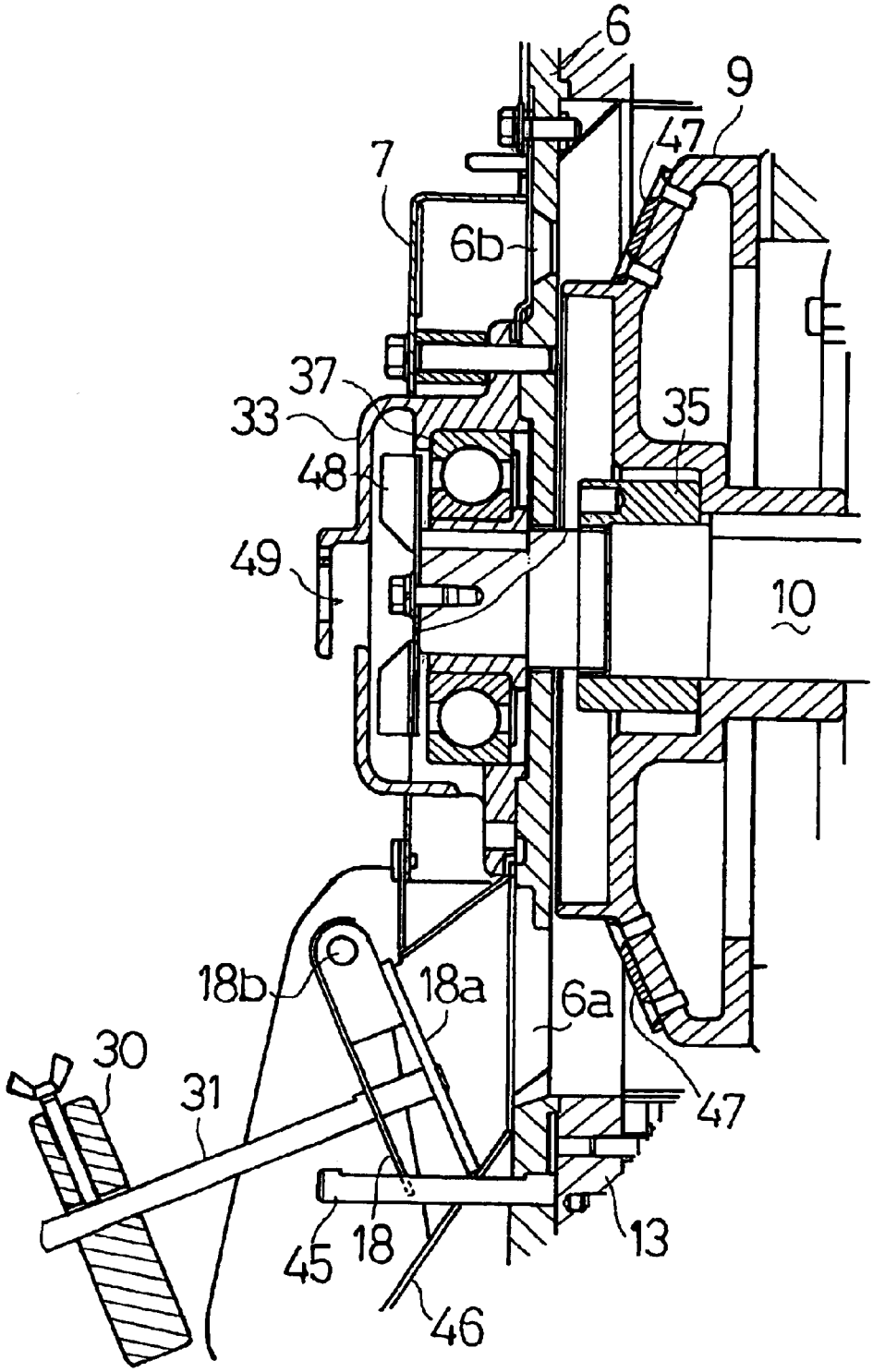
FIG. 16 is a partial side elevation view of the horizontal grinding-type rice polishing machine according to the present invention showing the position and structure of the polished rice outlets 6*a* and 6*b* and the adjusting shutter 18.
Figure 17:
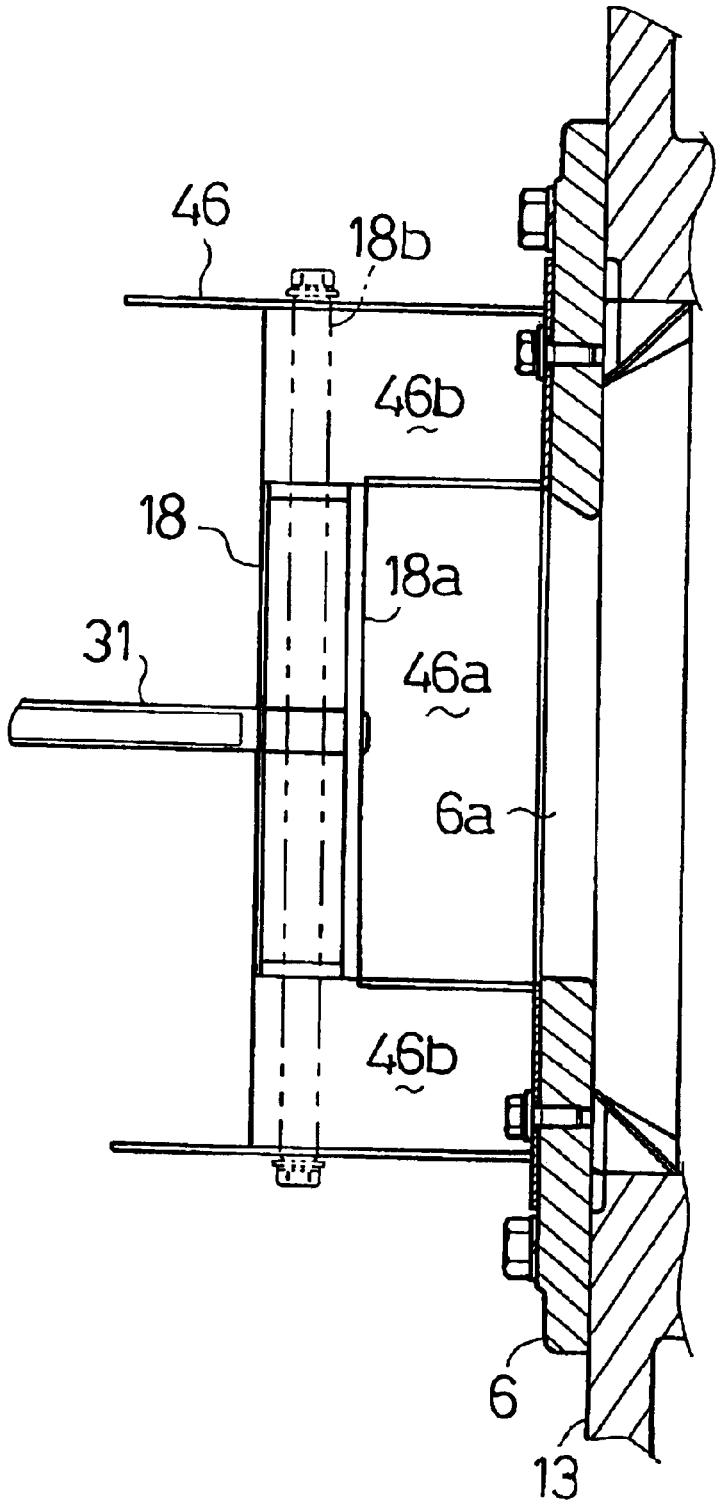
FIG. 17 is a plan view of the part of the polished rice outlet trough 46 of the horizontal grinding-type rice polishing machine.

In the lower part of the polished rice outlet member 6, as shown in FIGS. 2 and 15–17, a lower polished rice outlet 6*a* which is the primary outlet is opened, and in the upper part of the polished rice outlet member 6, as shown in FIG. 16, upper polished rice outlets 6*b* which are the secondary outlet are provided on the left and right sides on the bearing cover 33. That is, the polished rice outlet member 6 is provided with the total of three outlets of polished rice, all of which communicate with the opening 13*a* formed in the outlet side supporting panel 13 as shown in FIGS. 16 and 17.

As shown in FIGS. 15 to 17, a polisher rice outlet trough 46 extends outwardly in the downward diagonal direction from the lower polisher rice outlet 6*a*, and the polished rice outlet trough 46 comprises a left and right passages 46*b* for the polished rice dropping from the upper polished rice outlets 6*b* and a center passage 46*a* for the polished rice from the lower polished rice outlet 6*a*.

Furthermore, an outlet side cover 7 is attached on the front surface of the polished rice outlet member 6 so as to cover the upper polished rice outlets 6*b* and the front surface of the polished rice outlet member 6 in the vicinity of the bearing cover 33, and inside the outlet side cover 7, polished rice passages from the left and right upper polished rice outlets 6*b* to the left and right passages 46*b* in the polished rice outlet trough 46 are formed. In addition, transparent peep windows 32 are fitted into the outlet side cover 7 so as to oppose to each of the left and right upper polished rice outlets 6*b*, so that it is possible to visually check the discharge condition of the polished rice from the upper polished rice outlets 6*b* and the polishing degree of the polished rice.

Furthermore, it is also possible to make each of the upper polished rice outlets 6*b* capable of opening/closing, whereby when it is desired to reduce the rice polishing time, the polished rice is discharged from both of the two upper polished rice outlets 6*b*, and when it is desired to further improve the polishing degree no matter the rice polishing time is elongated, the polished rice is discharged from only one of the upper polished rice outlet 6*b*.

A pressure adjusting shutter 18 is provided so as to cover the polished rice outlet trough 46, of which upper end portion is pivoted so as to be able to swivel in the vertical direction on a horizontal pivot axis 18*b* which is hung on the polished rice outlet trough 46 above the lower polished rice outlet 6*a*. Also, inside the pressure adjusting shutter 18, a shutter for lower polished rice outlet 18*a* placed in the center passage 46*a* is integrally formed, of which lower end can completely close the lower polished rice outlet 6*a* by coming into contact with the floor surface of the center passage 46*a*. Incidentally, when the lower end of the shutter for lower polished rice outlet 18*a* is in contact with the floor surface of the center passage 46*a*, the pressure adjusting shutter 18 including the shutter for lower polished rice outlet 18*a* is somewhat inclined downward and rearward.

A weight attaching rod 31 is provided integrally with the pressure adjusting shutter 18 so as to protrude frontward and downward therefrom. To this weight attaching rod 31, an adjusting weight 30 can be attached while adjusting the number or position thereof, and the pressure adjusting shutter 18 is urged downward by the gravity exerted on the adjusting weight 30, which results in generation of a force pushing the lower end of the shutter for lower polished rice outlet 18*a* against the polished rice outlet trough 46 (center passage 46*a*). The magnitude of this pushing force determines the free opening of the lower polished rice outlet 6*a* That is, when the pushing force is weak, the free opening is large, so that the rice discharged from the lower polished rice outlet 6*a* pushes the shutter for lower polished rice outlet 18*a* and discharges along the center passage 46*a* The stronger the pushing force, the smaller the free opening is, and when the pushing force is made so strong that the free opening is nearly closed, the rice discharged from the lower polished rice outlet 6*a* is blocked by the shutter for lower polished rice outlet 18*a* so that it can no longer flow down along the center passage 46*a*.

Incidentally, a spare adjusting weight 30 is attached by passing the same on a spare weight attaching rod 45 which is horizontally provided on the outlet bearing support 6 so as to protrude therefrom in the vicinity of the polished rice outlet trough 46. When it is desired to increase the pushing force of the pressure adjusting shutter 18, the spare adjustment weight 30 is removed from the spare weight attaching rod 45 and is attached to the weight attaching rod 31. When it is desired to decrease the pushing force of the pressure adjusting shutter 18, excess adjusting weight 30 is removed from the weight attaching rod 31 and attached to the spare weight attaching rod 45.

In this way, by adjusting the number or position of the adjusting weight 30 to be attached to the weight attaching rod 31, the urge force of the pressure adjusting shutter 18 is adjusted, and the free opening of the lower polished rice outlet 6*a* is adjusted, with the result that the residence time of the rice within the rice polishing room formed between the bran removing screen S and the grinding rollers 1, that is, grinding time and loading amount are adjusted.

That is, in the case of raising the polishing degree of the polished rice to be discharged, the adjusting weight 30 on the weight attaching rod 31 is weighed to strengthen the pushing force of the pressure adjusting shutter 18 provided in the lower polished rice outlet 6*a* against discharging of the polished rice, that is, to strengthen the closing degree, thereby elongating the residence time of the polished rice in the rice polishing room between the grinding rollers 1 and the bran removing screen S. When the loading amount of the rice in the rice polishing room increases and the level position elevates as a consequence this, the polished rice is automatically discharged from the upper polished rice outlets 6*b*. Incidentally, in this situation, if the upper polished rice outlets 6*b* are designed to be able to open/close, and one of them is in the open state, the residence time and loading amount in the rice polishing room are further increased, so that the polishing degree is further elevated. The polished rice discharged from the upper polished rice outlets 6*b* passes inside the outlet side cover 7 and drops while being guided by the left and the right passages 46*b* of the polished rice outlet trough 46.

In the case of lowering the polishing degree of the polished rice, the degree of pushing of the pressure adjusting shutter 18 is lowered by adjusting the number and position of the adjusting weight 30 on the weight attaching rod 31. In this case, the polished rice mainly drops from the lower polished rice outlet 6*a* which is the primary outlet and drops into the center outlet 46*a* of the polished rice outlet trough 46.

As described above, by adjusting the free opening of the pressure adjusting shutter 18, the polished rice is discharged from only the lower polished rice outlet 6*a* which is the primary outlet when the rice polishing is conducted under the low polishing degree condition; from only the upper polished rice outlets 6*b* which is the secondary outlet when the rice polishing is conducted under the high polishing degree condition; and from the total of three outlets of the lower polished rice outlet 6*a* and the upper polished rice outlets 6*b* when the rice polishing is conducted under the intermediate polishing degree condition.

In this way, the polishing degree is adjusted by adjusting the free opening of the pressure adjusting shutter 18 and thus adjusting the residence time and loading amount of the rice in the rice polishing room, and in addition, even when the high polishing degree is selected, the polished rice is smoothly discharged by the upper polished rice outlet 6*b*, so that efficiency of rice polishing is secured.

Also, as shown in FIG. 16, in the bearing cover 33, a bearing cleaning fan 48 is fixed to the front end of the grinding roller shaft 10, which blows the air having taken from a cooling air intake 49 downwardly formed on the front end of the bearing cover 33 against the bearing 37. Small rice particles and bran that have leaked to the bearing 37 via the axial hole 6*c* of the polished rice outlet member 6 from the discharging roller 9 is returned to the side of the discharging roller 9 by this air, thereby preventing the bearing 37 from seizing up due to such adhered objects.

Furthermore, as illustrated in FIGS. 15 and 16, the outlet side of the discharging roller 9 is configured in a truncated cone shape, and an extruding member 47 for improving the discharge efficiency is provided in this part. The extruding member 47 is designed to be attachable on the surface of the truncated cone of the discharging roller 9 by mean of a bolt, and have a variable shape and thickness.

INDUSTRIAL APPLICABILITY

As described above, according to the horizontal grinding-type rice polishing machine of the present invention, changes of settings of rice communication passage within the rice polishing room and polished rice outlet can be easily made in accordance with the type of unpolished rice and intended polished degree with simple configuration, and moreover, vibration is reduced by improving the structure of introducing unpolished rice to the rice polishing room, resulting that high polishing angle and high durability of parts are realized. Therefore, according to the present invention, it is possible to provide a horizontal grinding-type rice polishing machine having high durability and practical flexibility with low cost.

What is claimed is:

1. A horizontal grinding-type rice polishing machine, comprising:

a grinding roller (1) fixedly and circularly installed on a horizontal rotation axis (10);

a concentric cylindrical bran removing screen (S), which can be separated into longitudinally split two screen halves (2); and a stopper (3) or a flap (4), wherein the grinding roller (1) is covered with the concentric cylindrical bran removing screen (S) to thereby form a rice polishing room, and wherein the stopper (3) or the flap (4) is fixedly provided on an inner peripheral surface of each of the two-part split screen halves (2) of the bran removing screen (S), the stopper (3) or the flap (4) being formed by a circular arc member which curves along the circumference of a circular cross section perpendicular to the axial center of the cylinder, so that between the flap (4) and the outer periphery of the grinding roller (1), a distance that allows passing of rice while restricting passing amount is secured, and a distance between the stopper (3) and the outer periphery of the grinding roller (1) prevents the rice from flowing;

wherein both of the screen halves (2) of the bran removing screen (S) have the same structure, and are so configured that when the respective ends in the axial direction are inverted, the stopper (3) and the flap (4) are inverted, and in the rice polishing machine, at least one screen half (2) can be arranged so that the respective ends in the axial direction are inverted.

2. The horizontal grinding-type rice polishing machine as set forth in claim 1, wherein, in each screen half (2), the total of even number of the stopper (3) and the flap (4) are attached so that they align alternately in the axial direction.

3. A horizontal grinding-type rice polishing machine, comprising:

a feeding roller (5);

a grinding roller (1);

a discharging roller (9);

a concentric cylindrical bran removing screen (S) covering the grinding roller (1) so as to form a rice polishing room;

a case (11) for accommodating the feeding roller (5); and a lifter latching block (8), wherein the feeding roller (5), the grinding roller (1) and the discharging roller (9) are circularly and fixedly installed on a horizontal rotation axis (10) in sequence from one end side to the other end side, wherein unpolished rice is supplied into the rice polishing room from the feeding roller (5) and polished by the grinding roller (1), and polished rice is discharged by the discharging roller (9), the horizontal grinding-type rice polishing machine, and wherein the case (11) has the lifter latching block (8), and the rotation axis (10) is supported in horizontal position by inserting the lifter latching block (8) between the feeding roller (5) that has been attached on the rotation axis (10) and the bearing support (11) which cantilevers the rotation axis (10) in installing the grinding roller (1) and the discharging roller (9) on the rotation axis (10).

4. The horizontal grinding-type rice polishing machine as set forth in claim 3, wherein the bearing support (11) is formed with a recess portion (15) nearest the position where the lifter latching block (8) is to be positioned for horizontally supporting the rotation axis (10), and the lifter latching block (8) not being used is fitted in the recess portion (15).

* * * * *